United States Patent [19]

Seidel et al.

[11] Patent Number: 4,723,770

[45] Date of Patent: Feb. 9, 1988

[54] STRAIGHT-LINE INSERT MACHINE

[75] Inventors: Randy R. Seidel, Allentown; Michael L. White, Easton, both of Pa.

[73] Assignee: Graphic Management Associates, Inc., Southborough, Mass.

[21] Appl. No.: 26,946

[22] Filed: Mar. 17, 1987

Related U.S. Application Data

[63] Continuation of Ser. No. 876,476, Jun. 20, 1986, abandoned.

[51] Int. Cl.[4] ..... B65H 5/30

[52] U.S. Cl. ..... 270/55; 270/57; 198/424; 198/626

[58] Field of Search ..... 270/54–57; 198/424, 626, 644; 271/196, 296, 204

[56] References Cited

U.S. PATENT DOCUMENTS

| | | | |
|---|---|---|---|
| 1,951,300 | 3/1934 | Zimmer | 270/55 |
| 2,461,573 | 2/1949 | Schweizer | 270/55 |
| 2,856,182 | 10/1958 | Cantrell | 270/57 |
| 3,711,083 | 1/1973 | Cantrell, Sr. | 270/55 |
| 4,046,367 | 9/1977 | Merker et al. | 270/55 |
| 4,124,203 | 11/1978 | Muller | 270/55 |
| 4,133,521 | 1/1979 | Muller | 270/55 |
| 4,398,710 | 8/1983 | Hansch | 270/55 |
| 4,479,643 | 10/1984 | Seidel | 270/55 |
| 4,496,141 | 1/1985 | Nayate | 270/55 |
| 4,681,213 | 7/1987 | Winiasz | 198/803.9 |

*Primary Examiner*—E. H. Eickholt

*Attorney, Agent, or Firm*—Davis Hoxie Faithfull & Hapgood

[57] ABSTRACT

A straight-line insert machine for inserting materials into a newspaper jacket is disclosed. The jacket is positioned in a moving pocket which is hinged but closed at the bottom such that when the pocket opens, as vacuum is applied to the walls of the pockets, the jacket opens. Vacuum flanges moving at the same linear speed as the pockets mate with vacuum stems attached to the pockets for a predetermined time and apply vacuum to the walls of the pocket so that the front and rear portions of the newspaper jacket are held against the fixed and movable walls, respectively, as the pocket opens. The pockets and vacuum system are synchronously driven. Camming action is used to open and close the pockets. Insert hoppers place insert materials into the open jackets. Because the machine is modular, additional insert hoppers and pockets can be added. A gripper-conveyor system, which is also synchronously driven with the pockets and vacuum system, picks up the newspaper with inserts from the top of a closed pocket and delivers the newspaper with inserts to a drop-off point such as a tray or a stacker.

14 Claims, 11 Drawing Figures

STRAIGHT-LINE INSERT MACHINE

This application is a continuation of U.S. application Ser. No. 876,476, filed June 20, 1986 and now abandoned.

FIELD OF THE INVENTION

This invention relates to a straight-line insert machine for inserting materials into an outer-jacket portion, particularly a newspaper jacket.

BACKGROUND OF THE INVENTION

For newspaper operations, it has long been desired to have fast, efficient and modular apparatus for inserting sections into the outer portion of a newspaper known as a newspaper jacket. Some prior attempts to provide such apparatus are shown in U.S. Pat. Nos. 4,133,521, 4,046,367, 3,711,083, 2,856,182, 2,461,573 and 1,951,300.

Some prior art machines are rotary in configuration and others are linear in design. Other features found in prior art systems include pockets with movable walls open at the top or bottom for holding the newspaper jacket; vacuum systems for separating the front and rear jacket portions while the pocket is opening; and means to remove the newspaper from the pocket after all insert sections have been inserted. Some systems use moving pockets and others utilize stationary pockets.

The present invention discloses a straight-line insert machine which provides a more effective insert operation than prior art machines. The machine of the present invention is also modular in form, thus allowing any number of insert sections (from insert hoppers) to be inserted in the newspaper jacket. The present invention also allows for adding pockets and associated frame structure to the machine in order to accommodate expansion of the machine.

SUMMARY OF THE INVENTION

The present invention is for a straight-line insert machine for inserting material into an open newspaper jacket. The machine has a series of pockets which move in a closed path, each pocket holding a single newspaper jacket. Each pocket also has a fixed wall and a movable wall hinged at the bottom of the pocket.

As the pockets move by a jacket hopper, the jacket hopper inserts a jacket into each pocket. The pocket is then closed by moving the movable wall toward the fixed wall. Vacuum is then applied to the movable wall and the fixed wall. As the pocket opens, the suction from the vacuum opens the jacket by causing a rear jacket portion to be held against the movable wall and a front jacket portion to be held against the fixed wall.

The vacuum is then removed and one or more insert sections are inserted into the open jacket by one or more insert hoppers. After all insert sections have been inserted into the jacket, the pocket is closed and a gripper mechanism picks up the newspaper with inserts from the top of the closed pocket.

It is an object of the invention to provide a modular, straight-line insert machine wherein additional insert hoppers and pockets may be added to the machine.

It is another object of the invention to provide a straight-line insert machine where the jacket hopper and the insert hoppers may be loaded from either side of the machine.

It is another object of the invention to provide a straight-line insert machine where the moving pockets, a gripper-conveyor mechanism and a vacuum system for applying suction to the pocket walls are all driven synchronously.

It is another object of the invention to provide a straight-line insert machine where adjacent insert hoppers can be oriented 180° opposite one another so that one person can easily feed two insert hoppers.

DETAILED DESCRIPTION OF THE INVENTION

Figure 1:
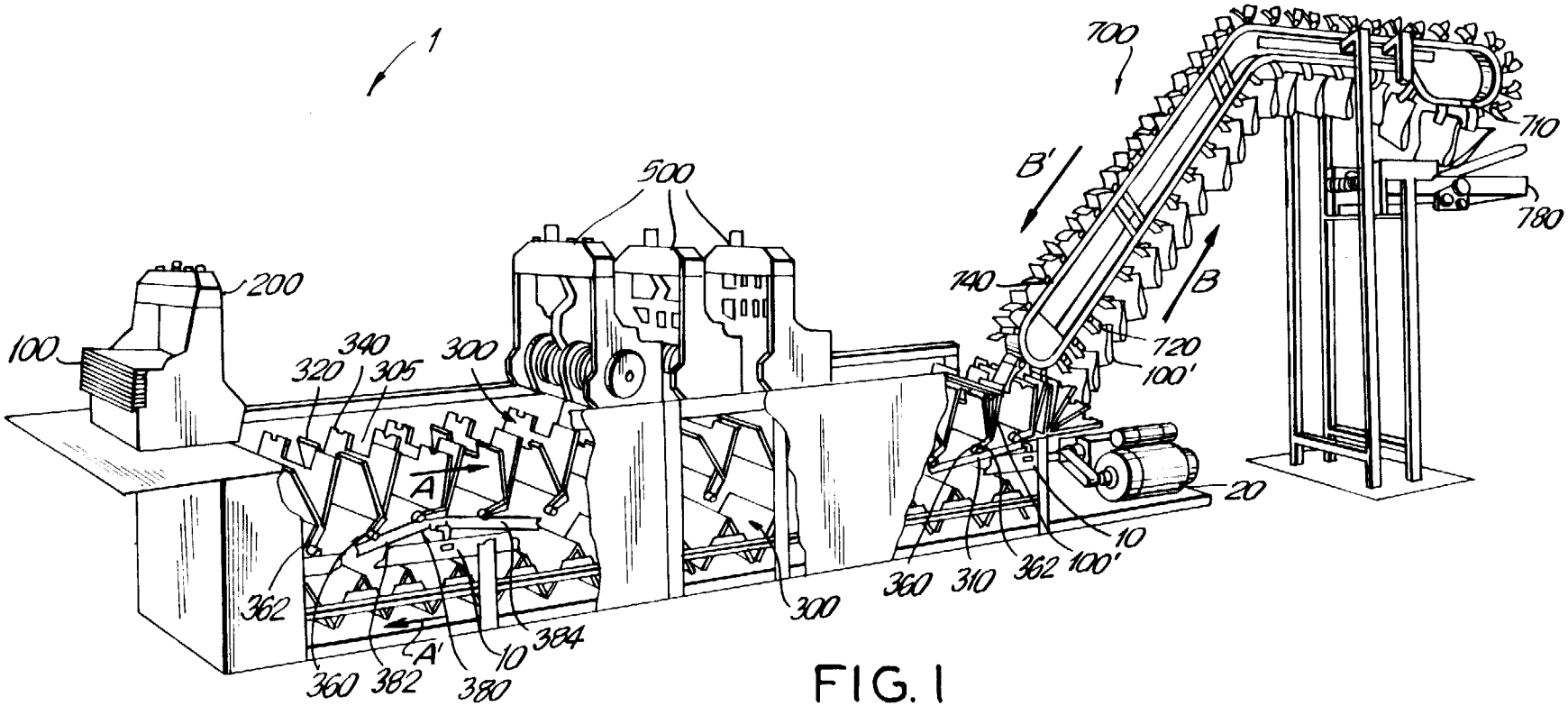
FIG. 1 is a perspective view, partly in section, of a portion of a straight-line insert machine of the present invention showing three insert hoppers for the insertion of insert sections into a newspaper jacket.

Referring now by reference characters of the figures which illustrate an embodiment of the present invention, straight-line insert machine 1 functions to insert newspaper insert section, and also materials such as advertising literature or special supplements, into the outer-folded portion of the newspaper known as the newspaper jacket. Any number of insert sections may be inserted into the newspaper jacket, depending upon the number of insert hoppers which are used with the machine.

It is to be understood that the invention is not limited to a machine for inserting newspaper insert sections into a newspaper jacket; rather, the invention includes a machine for inserting any materials into the outer folded portion of any item, for example, for not limited to magazines, brochures, pamphlets and the like.

In the FIG. 1 embodiment, three insert hoppers 500 are used, with each insert hopper dropping one insert section into the open newspaper jacket. However, it is understood that the number of insert hoppers is dictated by the number of inserts which need to be inserted, and the straight line, modular construction of the machine of the present invention allows for any number of insert hoppers. The modular construction also allows for additional pockets to be added.

A general description of the operation of the machine 1 of FIG. 1 is given below, followed by a detailed description of the various parts of the machine.

GENERAL DESCRIPTION OF OPERATION

A stack of newspaper jackets 100 is placed in jacket hopper 200, which is of conventional construction. Similar jacket hoppers to those used in the present invention include hoppers manufactured by Grapha-Holding AG, Harris Graphics Corp., McCain Manufacturing Corp., and Custom-Bilt Machinery, Inc., and others. The jacket hopper 200 operates in a manner well-known in the art. The jackets 100 are dropped one by one into moving pockets 300 as the pockets 300 pass beneath the jacket hopper 200 in the direction of arrow A of FIGS. 1, 2 and 3. The jacket hopper 200 is synchronously driven with the movement of the pockets 300 and therefore the dispensing speed of the jacket hopper 200 matches the linear speed of movement of the pockets 300.

Figure 2:
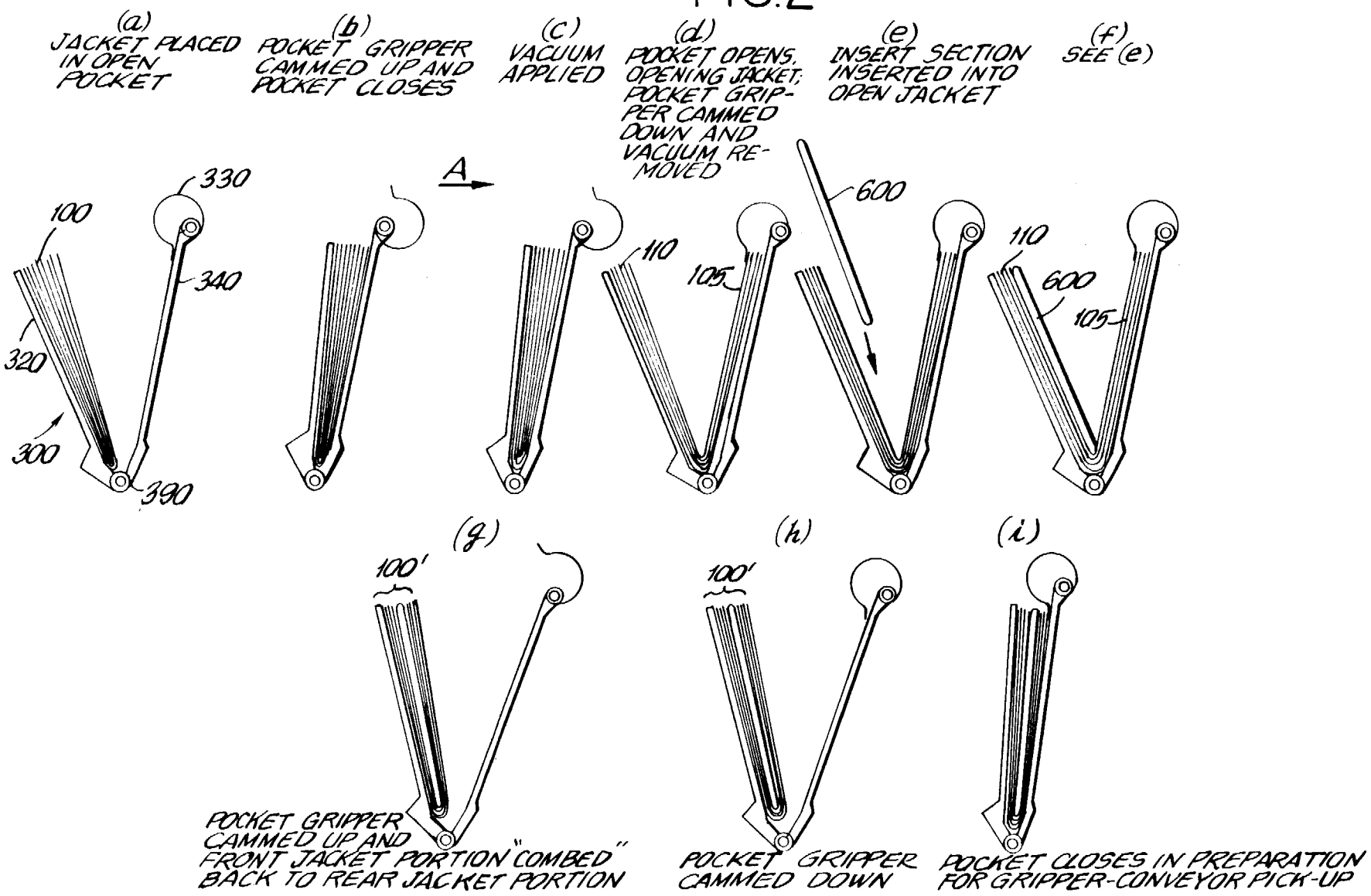
FIG. 2 is a schematic elevational view of the pockets of the machine of FIG. 1 showing the process of the insertion of one insert section into the newspaper jacket.

After a jacket 100 has been dropped into a pocket 300, the jacket 100 rests, for example, against a movable wall 320 of the pocket 300, as shown in position (a), FIG. 2.

Figure 3:
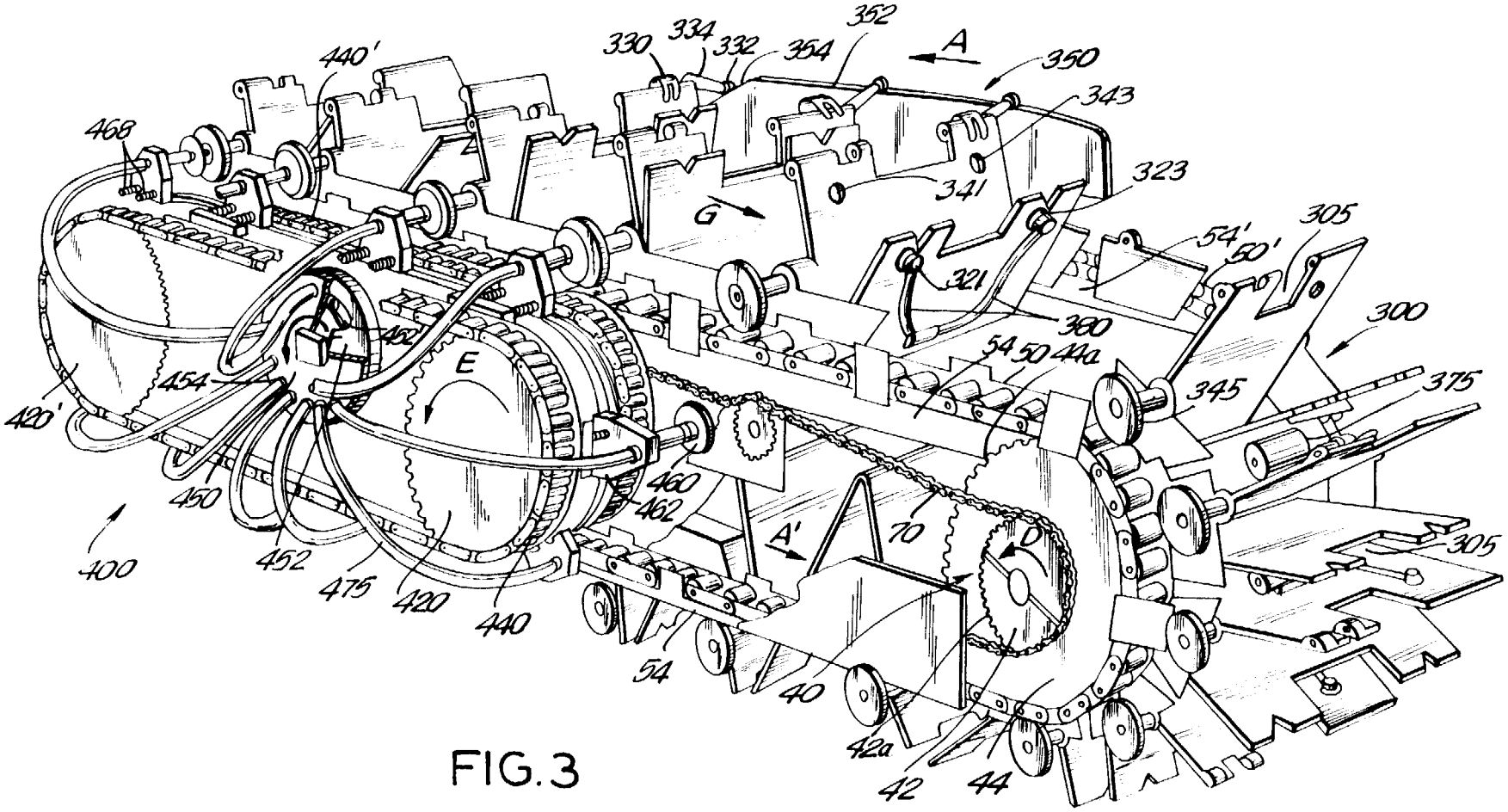
FIG. 3 is a perspective view, partly in section, of the pockets, the vacuum system and synchronous drive system of the machine of FIG. 1 from the opposite side of the view of FIG. 1.
Figure 8:
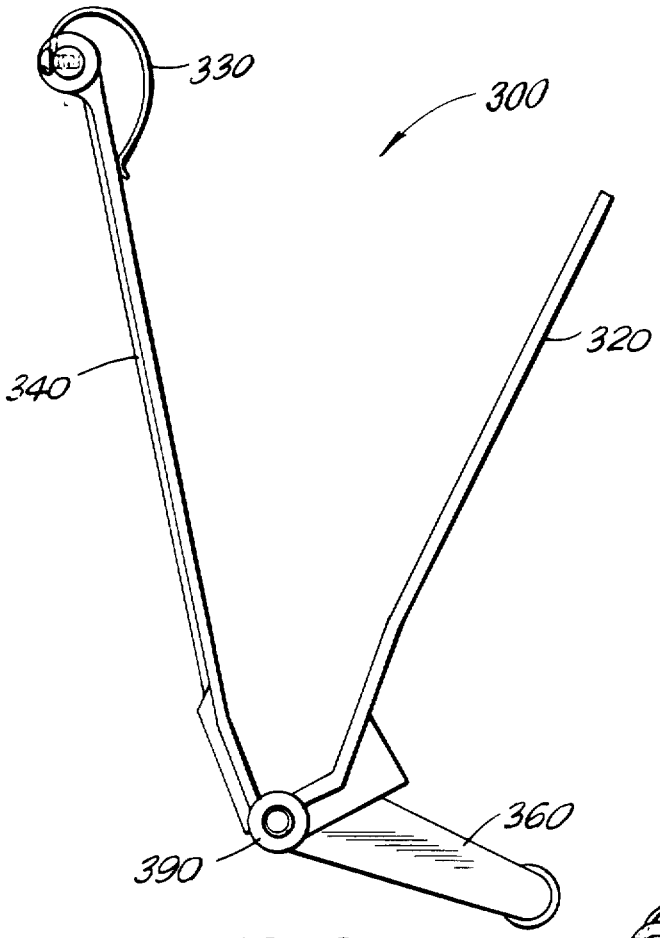
FIG. 8 is a side elevational view in simplified form of a pocket of FIG. 1 in the open position with the view shown in FIG. 8 being taken from the opposite side of the machine and pockets shown in FIGS. 1 and 2.
Figure 9:
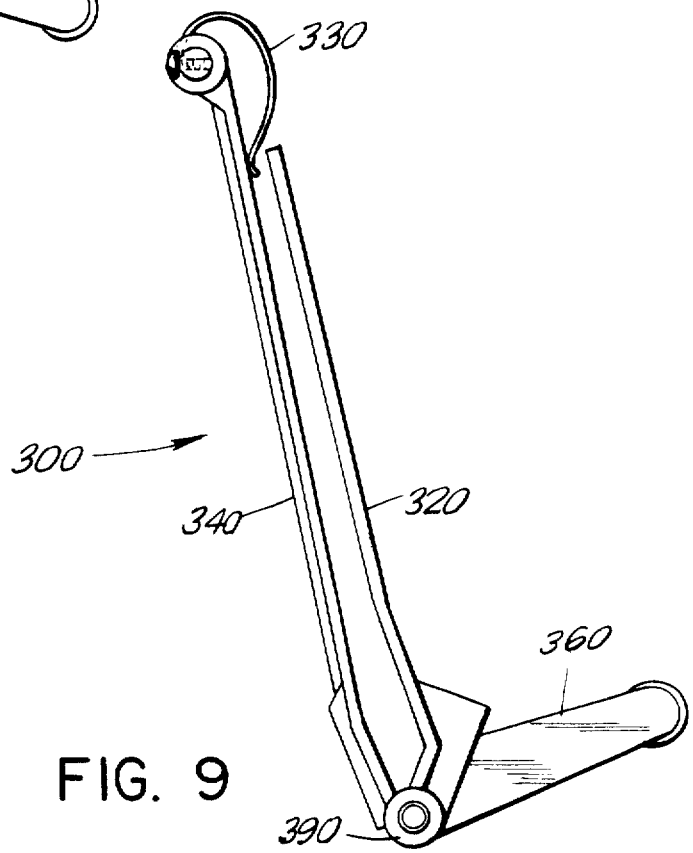
FIG. 9 is a side elevational view of the pocket of FIG. 8 in the closed position.

As the pocket 300 travels in the direction of arrow A in FIGS. 1, 2 and 3, the movable wall 320 of the pocket 300 moves toward a fixed wall 340 of the pocket 300, moving from the position shown in FIG. 8 to the position shown in FIG. 9, which correspond to FIG. 2, positions (a) and (b), respectively. FIGS. 8 and 9 are side elevational views of the pocket 300 from the opposite side of the view of FIG. 2. In FIG. 9, pocket griper 330 is in the "down" position; in position (b), FIG. 2, the pocket gripper 330 is in the "up" position. Further, FIGS. 8 and 9 do not show the jacket 100 in the pocket 300.

The manner in which the movable wall 320 is pivoted toward fixed wall 340, and the function of the pocket gripper 330, is described in detail below in the section entitled "Pocket Structure and Operation."

As movable wall 320 pivots towards its closed position, jacket 100 is positioned between movable wall 320 and fixed wall 340 as seen in position (b) of FIG. 2. Vacuum system 400, shown generally in FIG. 3 and in more detail in FIGS. 10A and 10B, then applies vacuum to pocket ports 341 and 343 on the fixed wall 340 and to pocket ports 321 and 323 on the movable wall 320, creating a suction effect on a first or front jacket portion 105 and a second or rear jacket portion 110 of the jacket 100, respectively. Shortly after the vacuum is applied, movable wall 320 pivots downwardly into the open position from the position shown in FIG. 9 and FIG. 2 (position (c)) to the position shown in FIG. 8 and FIG. 2 (position (d)), thus opening up the pocket 300 and causing the jacket 100 to open.

The application of vacuum to the pocket ports 321, 323, 341 and 343 holds rear jacket portion 110 against movable wall 320 and holds front jacket portion 105 against the fixed wall 340 as the movable wall 320 moves to open pocket position (d) of FIG. 2. The application of the vacuum insures that the jacket 100 will open properly as the movable wall 320 moves to the open position. The suction from vacuum system 400 is then removed with respect to that particular pocket, and a short burst of low-pressure air is sent through the vacuum system 400 to clean all vacuum lines and to free any piece of the jacket 100 which has been sucked into any of the ports.

However, even when the vacuum to the pocket ports 321, 323, 341, 343 is removed, the jacket 100 remains open. The rear jacket portion 110 of the jacket 100 is held by gravity against the movable wall 320 because wall 320, when in the open position, pivots to an angle of approximately 25° negative in relation to 0° vertical. The front jacket portion 105 of the jacket 100 is held against the fixed wall 340 by a pocket gripper 330 which swings down against the front jacket portion 105 as shown in position (d), FIG. 2. A spring force in the pocket gripper 330 holds the gripper 330 against the front jacket portion 105, and thus secures the front jacket portion 105 against the fixed wall 340. Fixed wall 340 is further at a 15° positive angle to vertical. It has been found that the effect of gravity at this angle, together with the force exerted by pocket gripper 330, insures that the jacket portion 105 remains against the fixed wall 340. A more detailed description of the pocket gripper is contained in the section entitled "Pocket Structure and Operation."

It is an advantage to have the fixed wall 340 at a 15° positive angle rather than at 0° vertical because, when the jacket 100 is forced toward the fixed wall 340 prior to the application of the vacuum (position (b), FIG. 2), the movable wall 340 and the jacket 100 are rotated beyond the center line of 0° vertical, resulting in a tendency, due to gravity, for the jacket 100 to stay against the fixed wall 340. When vacuum is applied and the pocket opened (positions (c) and (d), FIG. 2), the suction on the movable wall 320 will move only the rear jacket portion 110 with that wall. If the fixed wall 340 were at 0°, the opening of the pocket 300 after the application of vacuum could result in partial or improper opening of the jacket 100.

As a pocket 300 passes underneath the first insert hopper 500, the hopper 500 drops an insert section 600 into the jacket 100 as shown in FIG. 2, positions (e) and (f). As with the jacket hopper 200, the insert hopper 500 will dispense the insert 600 in synchronization with the arrival of the open pocket 300. The insert hoppers 500, three of which are shown in FIG. 1, operate in a conventional manner. Similar insert hoppers to those used in the present invention include hoppers manufactured by Grapha-Holding AG, Harris Graphics Corp., McCain Manufacturing Corp., and Custom-Bilt Machinery, Inc., and others. It is to be understood that additional inserts may be inserted into the open jacket in the same manner, such inserts being placed in the jacket at position (f) of FIG. 2.

After as many inserts as desired are placed into the jacket 100, the pocket gripper 330 is cammed up to the open position and the front jacket portion 105 of the jacket 100 is moved away from the fixed wall 340 to position (g) of FIG. 2. This moving of "combing" of the front jacket portion 105 away from the fixed wall 340 is accomplished in the present embodiment by a stationary spring-loaded rod of conventional construction (not shown) which is secured to the frame 10 of the machine 1. As the pocket 300 moves past the spring-loaded rod, the rod pushes or "combs" the front jacket portion 105 away from the fixed wall 340. Any other suitable means may be used to comb the front portion 105 away from the fixed wall 340.

After the front jacket portion 105 is combed away from the fixed wall 340, pocket gripper 330 is cammed down to the position shown in position (h) of FIG. 2 and the pocket 300 closes to the position shown in position (i) of FIG. 2. A complete newspaper 100' (consisting of the jacket 100 and insert sections 600) is not ready for pickup by a gripper-conveyor system 700.

The front jacket portion 105 is combed back to the movable wall 320 so that the pocket gripper 330 may be cammed down prior to newspaper pick-up by the gripper-conveyor 700. It is necessary to lower the pocket gripper 330 prior to pick-up by the gripper-conveyor so that it does not interfere with the pick-up action of the gripper-conveyor 700, as described below.

Figure 4:
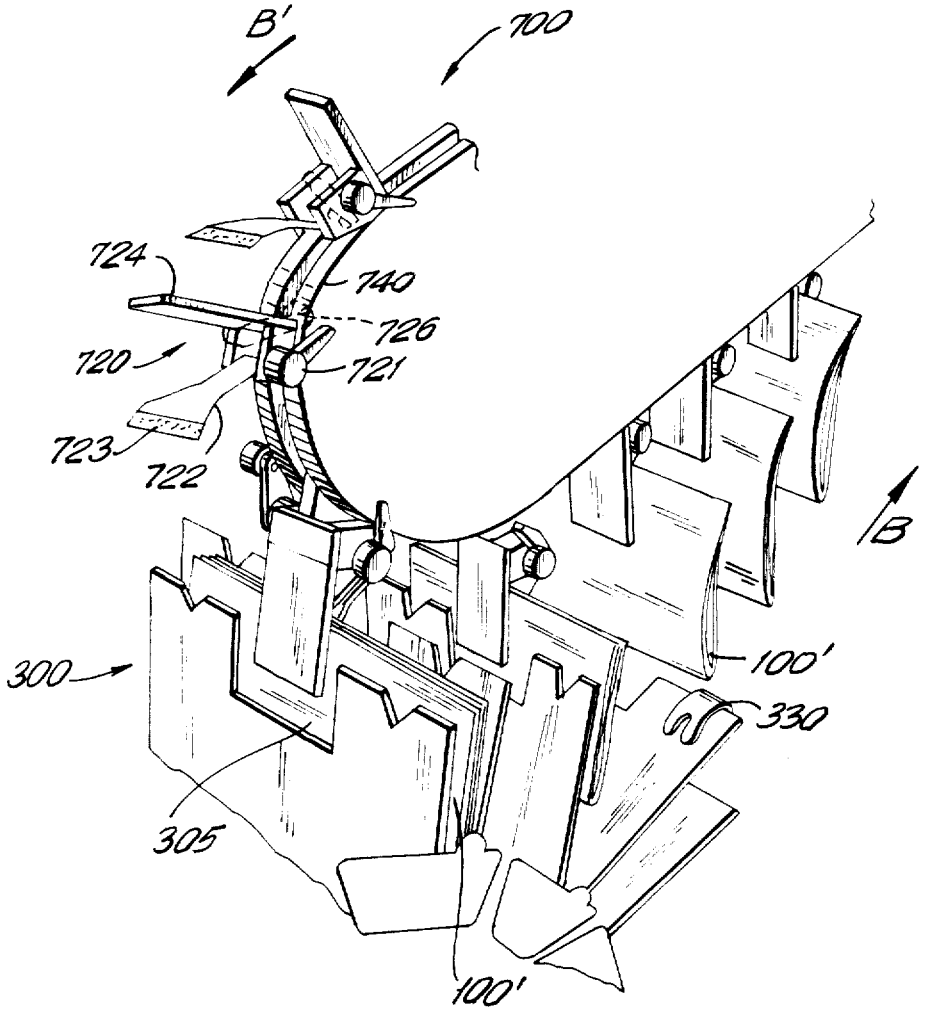
FIG. 4 is a perspective view of the synchronously-driven gripper-conveyor section of the machine of FIG. 1 showing the gripper mechanism of the gripper-conveyor picking up a newspaper with inserts from a pocket of the machine.

Gripper mechanism 720, attached to a moving conveyor 740 which is traveling in a generally oval closed path in the direction of arrows B and B' of FIGS. 1 and 4, comes into overlying relation with the newspaper 100' as seen in FIG. 4. At this time the gripper mechanism 720 is in the open position shown in FIG. 5. As a movable pad 722 and a fixed pad 724 of the gripper 720 pass over the newspaper 100' in the pocket 300, the movable pad 722 pivots toward the fixed pad 724, causing the gripper 720 to close over and forceably grip the newspaper 100' and carry the newspaper away from the pocket 300. Rough surface 727 on movable pad 722 aids by friction the gripping force of gripper mechanism 720 to hold newspaper 100'.

Figure 5:
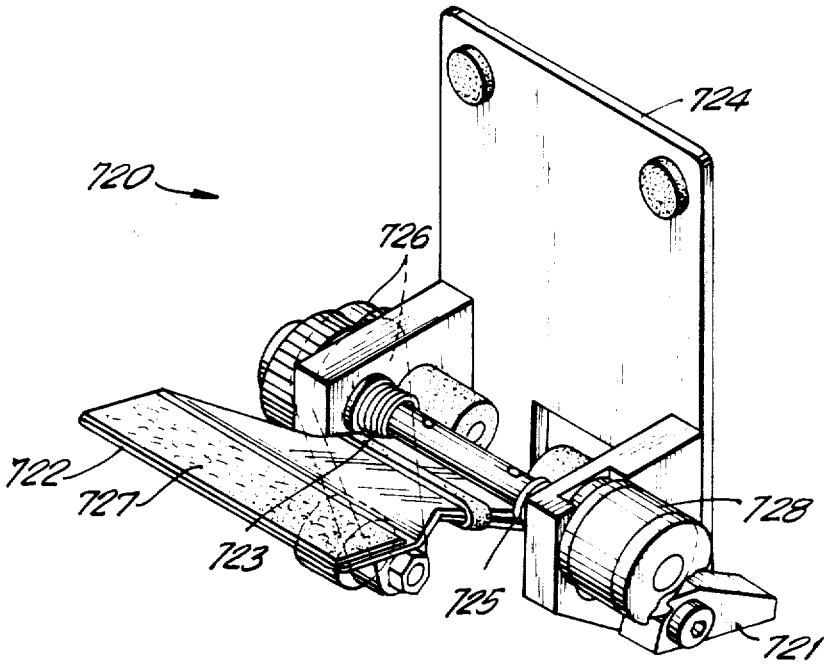
FIG. 5 is a perspective view in isolation of the gripper mechanism of FIG. 4 in the open position.
Figure 6:
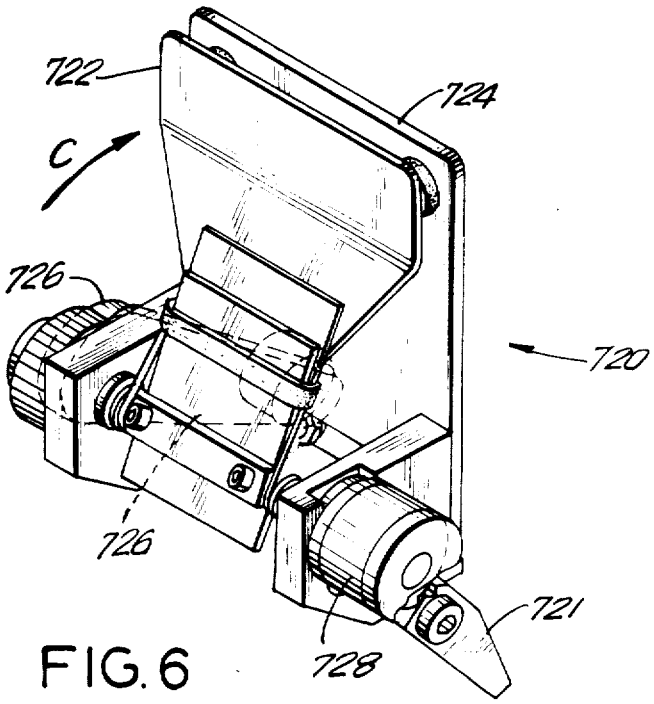
FIG. 6 is a perspective view in isolation of the gripper mechanism of FIG. 4 in the closed position.

The movable pad 722 is caused to pivot because gripper cam arm 726, shown in dotted line in FIGS. 4, 5 and 6, rides up on a stationary gripper cam (not shown) which is attached to the frame of the gripper-conveyor 700. Cam arm 726 is on the same axis of rotation as movable pad 722 as seen in FIGS. 5 and 6, and therefore when cam arm 726 rotates in response to riding on the gripper cam, movable pad 722 will also rotate upwardly and will move from the position shown in FIG. 5 to the position shown in FIG. 6 in the direction of arrow C of FIG. 6.

A cutout section 305 in each wall of the pocket 300 provides space for the pads 722 and 724 of the gripper mechanism 720 to come into direct contact with the newspaper 100' without contacting the walls 320 and 340 of the pocket 300. The pocket gripper 330, which has been lowered against the fixed wall 340 (position (h), FIG. 2) prior to pick-up of newspaper 100' by the gripper mechanism 720, also does not contact the gripper mechanism 720 and therefore does not interfere with the pick-up.

Because conveyor 740 is driven synchronously with the movement of the pockets 300, each gripper mechanism 720, as it travels on moving conveyor 740, will be properly positioned for the pick up of a newspaper 100' out of a corresponding pocket 300. The successive gripper mechanisms 720 will likewise be properly positioned for successive newspaper pickups as the pockets 300 and the conveyor 740 move in sequence.

Commercial one-way clutch 728 operates to prevent any movement of the movable pad 722 in the direction opposite to arrow C in FIG. 6 unless a latch 721 is contacted or engaged, thus releasing the clutch 728. Therefore, once the gripper mechanism 720 closes over the newspaper 100', the newspaper 100' will be held by the gripper mechanism 720 until such time as latch 721 contacts a release cam or block 710 (shown in FIG. 1), or some other release mechanism, thus releasing the one-way clutch 728.

Gripper mechanism 720, which moves with conveyor 740, carries the newspaper 100' to a drop-off point such as tray 780. As the gripper 720 reaches the tray 780, the protruding stationary block 710 on the frame of the gripper-conveyor 700 is contacted by the release latch 721 on the gripper mechanism 720. This causes one-way clutch 728 to release and the movable pad 722 to snap open (FIG. 5) under spring bias pressure from springs 723 and 725 on gripper mechanism 720. This releases the newspaper 100' from the gripper mechanism 720 and causes the newspaper to drop into the tray 780. From the tray 780 the newspapers 100' can be fed to a stacker (not shown) or to another paper handling device for further processing and distribution. Provision may also be made for a reject mechanism for rejecting newspapers which have not properly received the intended insert sections, preferably at a point prior to the location of protruding stationary block 710.

It is to be understood that multiple drop-off points for the newspaper 100' are possible. Air-operated solenoids (not shown) can be used, at positions prior to tray 780, to release latch 721 and thus open the gripper mechanism 720 when desired, for instance for every second newspaper, every third newspaper, every fourth newspaper, etc. This provides the opportunity for use of a number of trays similar to tray 780 to form several stacks of completed newspapers simultaneously.

POCKET STRUCTURE AND OPERATION

As described above, pocket 300 closes (position (b) of FIG. 2), after the pocket gripper 330 is cammed upward, out of the way of the closing pocket 300 and prior to the application of vacuum from vacuum system 400. The pocket 300 is closed in the following manner. Cam 380, shown in FIG. 1, which is stationary and is secured to the frame 10 of the machine 1, has an upward elevated portion 382 used for closing the pocket 300. Cam follower 360 on pocket 300, seen in FIGS. 1, 7, 8 and 9, rides up on the surface 382 of cam 380, causing the movable wall 320 of the pocket 300 to pivot toward the fixed wall 340 of the pocket 300.

Cam follower 360 is attached to a pocket cam follower arm 362 which is attached to the hinge 390 of the pocket 300. As seen in FIGS. 8 and 9, the cam follower arm 362 and the movable wall 320 both have an axis of rotation along hinge 390, and therefore when cam follower arm 362 rotates while following the upward elevation of surface 382, the movable wall 320 will also rotate upwardly, causing the pocket 300 to close. In a similar fashion, pocket 300 is opened prior to insertion of insert 600 by insert hopper 500 (position (d) of FIG. 2) when cam followr 360 rides downwardly on a second surface 384 of cam 380. The relative height from the floor and the shape of cam 380 affect the rotational speed of the opening and closing of the pocket 300. The present embodiment allows for height adjustment of the cam 380.

The closing of the pocket 300 to position (i) of FIG. 2, after all insert sections 600 have been inserted in the open jacket 100, is accomplished by cam follower 360 riding up on cam 310, shown in FIG. 1. Cam 310, like cam 380, is stationary and is secured to the frame 10 of the machine 1. The height from the floor and the shape of cam 310 dictate how quickly and how far the pocket 300 is closed. The present embodiment allows for height adjustment of the cam 310.

Figure 7:
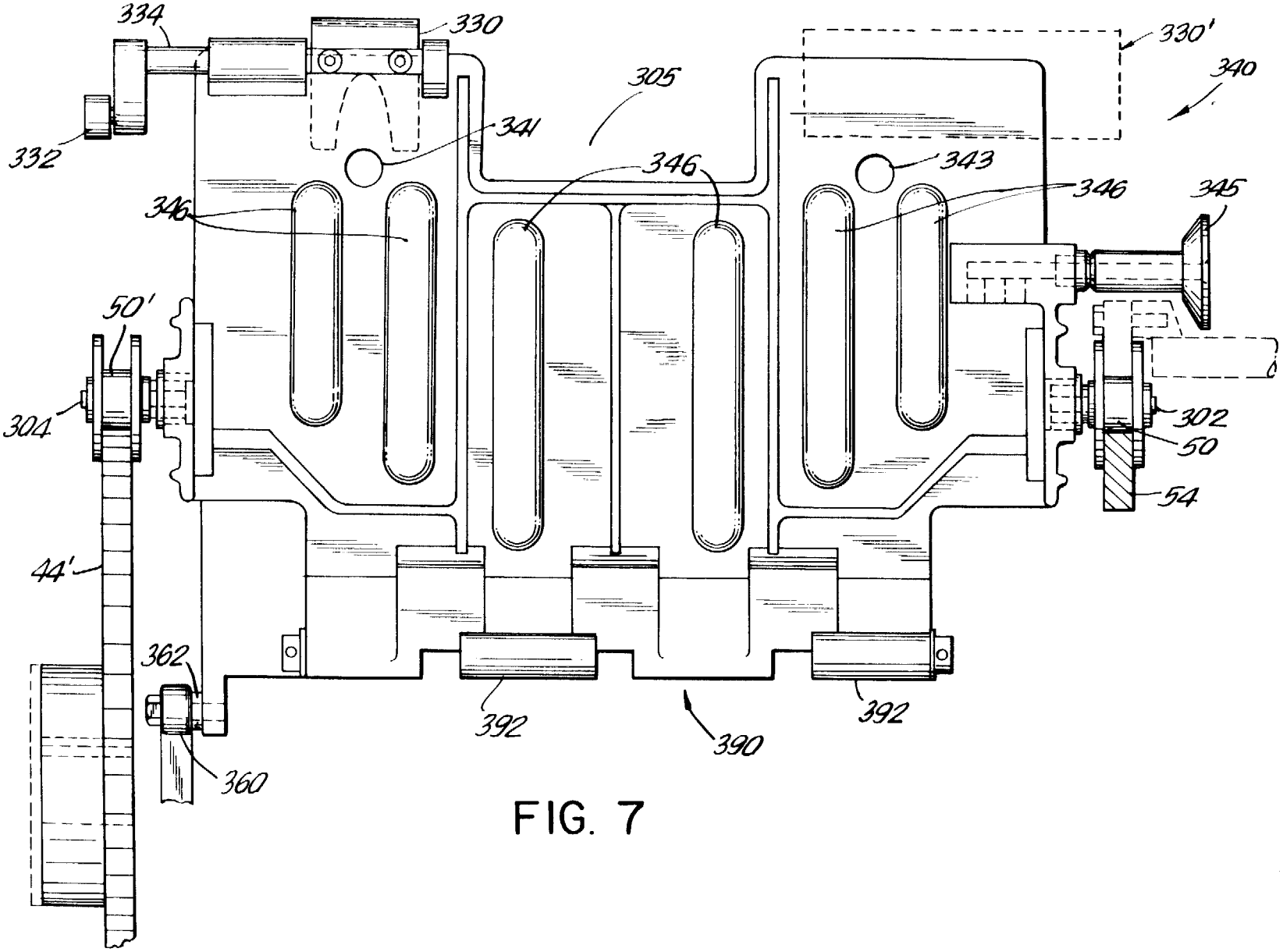
FIG. 7 is an elevational view of the fixed wall of the pocket in the direction of arrow G of FIG. 3.

Pocket gripper 330, which, as previously described, is used to hold the front jacket portion 105 against the fixed wall 340 for positions (d), (e) and (f) of FIG. 2, is rotatably mounted on fixed wall 340. A pocket gripper cam follower 332, shown in FIGS. 3 and 7, is mounted on the same axis of rotation as the pocket gripper 330 through pocket gripper cam follower arm 334. As pocket gripper cam follower 332 rides up surface 352 on cam 350 (FIG. 3), cam follower arm 334 will rotate causing the pocket gripper 330 to rotate upwardly to position (b) of FIG. 2. Then, as pocket gripper cam followre arm 334 rides down surface 354 on cam 350, cam follower arm 334 will rotate causing the pocket gripper 330 to rotate downwardly and press against the front jacket portion 105, holding jacket portion 105 against the fixed wall 340 as shown in position (d), FIG. 2. The metal of the gripper 330 has a built-in spring force which insures that the front jacket portion 105 will be firmly held against the fixed wall 340.

After all inserts 600 have been deposited into the open jacket 100, the pocket gripper 330 is cammed up to position (g) of FIG. 2. The front jacket portion 105 is then combed away from the fixed wall 340, as previously described, the pocket gripper cammed down against wall 340 (position (h), FIG. 2), and the pocket closed to position (i) of FIG. 2. The camming action for lowering the pocket gripper 330 (positions (h)–(i) of FIG. 2) results from cam follower 332 riding upwardly on another stationary cam (not shown), attached to the frame 10 of the machine 1, causing a rotational motion of the gripper 330. The pocket gripper 330 is cammed down against the fixed wall 340 (position (h) and (i), FIG. 2) so that the pocket gripper 330 does not interfere with the pick up of the newspaper 100' by the gripper mechanism 720, as previously described. It is to be understood that there can be two pocket grippers 330 on each fixed wall 340 of each pocket 300, where the second pocket gripper, pocket gripper cam follower, and pocket gripper cam follower arm are identical to the pocket gripper 330, the pocket gripper cam follower 332 and the cam follower arm 334 described above. The second pocket gripper, gripper cam follower and cam follower arm are located within the dotted lines designated as 330' in FIG. 7. If a second gripper 330 and associated components are used, a second cam is also required on the side of the machine opposite to cam 350 in FIG. 3.

The fixed wall 340 of the pocket 320 is shown in detail in FIG. 7. Pins 302 and 304 secure the fixed wall 340 to roller chains 50 and 50', which support and drive the pockets 300 in the manner described below. FIG. 7 shows roller chain 50' on sprocket 44' and roller chain 50 on a support rail 54 secured to the frame 10. Roller chains 50 and 50', sprockets 44 and 44' and support rail 54 are further described below in the section entitled "Synchronous Drive System."

Pocket ports 341 and 343 on fixed wall 340 are shown in FIG. 7. These ports, as well as ports 321 and 323 on the movable wall 320, receive a vacuum through hoses 380, from pocket suction stem 345 which mates with vacuum system flange 460 in the manner described below in conjunction with the description of the vacuum system 400. Not all houses 380 and pocket ports 321, 323, 341 and 343 are shown in FIG. 3, but it is to be understood that such hoses are attached to each port 321, 323, 341, 343 and each pocket wall has two ports.

Slots 346 on the fixed wall 340 lighten the weight of fixed wall 340 so that a minimum of force is required to move the pockets 300. There are similar slots on the movable wall 320. Slots on the pocket walls are not shown in FIG. 3, but it is to be understood that such slots are present in the preferred embodiment. The fixed wall 340 and the movable wall 320 each also have a cut-out section 305 so that the gripper mechanism 720 is able to grab the newspaper 100' without contacting the walls 320 and 340.

As seen in FIGS. 8 and 9, the pocket 300 is hinged at the bottom and the movable wall 320 will pivot on the hinge 390. The cam follower 360 is also attached to the pocket 300 at the hinge 390. FIGS. 8 and 9 show the pocket 300 in simplified form in order to highlight the hinging feature and to show the related movement of cam follower 360 and movable wall 320.

Although FIG. 2 shows the open jacket 100 resting in the pocket 300 in a "V" configuration, in actuality the open jacket 100 is similar to a "U" configuration, due to the relative shapes of the walls 320 and 340, thus providing a larger opening in the jacket 100 for the insertion of the insert sections 600. Bosses 392 at the hinge 390 of the fixed wall 340 provide a surface for the bottom fold of the jacket 100 to rest on when the pocket is closed to position (b) of FIG. 2.

As the pocket 300 is opened to position (d) of FIG. 2, the jacket 100 will open in more of a "U" fashion because the fold of the jacket 100 remains on the bosses 392. Bosses (not shown) of a smaller diameter at the hinge area of the movable wall 320 do not carry the jacket fold with the movable wall 320 as the pocket opens because of their smaller size in relation to the bosses 392. With the fold of the jacket 100 remaining on the bosses 392 of the fixed wall 340 and the pocket gripper 330 holding the front jacket portion 105 of the jacket 100 in place as the movable pocket wall 320 moves to the open position, the shape of the jacket 100 will tend to follow the contour of the open pocket once the pocket is past the pont where the vacuum has been removed. Thus, the rear jacket portion 110, not held by a pocket gripper, will tend to sag to form more of a "U" shape, looking at the jacket 100 in cross section.

A "U" shaped open jacket 100 provides a larger throat area for the insertion of insert sections into the open jacket.

Roller 375, attached to the fixed wall 340 of each pocket 300, serves as a fixed stop for the movable pocket wall 320. Roller 375, which is made of compressible material, prevents the movable wall 320 for moving beyond approximately a 25° open position by abutting the movable wall 320 of the next pocket. FIG. 3 shows one roller 375, but it is to be understood that each pocket has a roller 375 on its fixed wall.

The movable wall 320 is similar in shape to the fixed wall 340 shown in FIG. 7 except that the movable wall 320 does not have the pocket gripper 330, the cam follower arm 334, the cam follower 332 or the vacuum stem 345.

SYNCHRONOUS DRIVE SYSTEM

Main motor drive 20 synchronously drives the pockets 300, the vacuum system 400 and the gripper-conveyor 700 and also the jacket hopper 200 and the insert hoppers 500 so that all mechanisms move at the same linear speed, or in the case of the hoppers 200 and 500, deliver materials at the proper speed.

Drive sprocket 40 is used to synchronously drive the pockets 300 and the vacuum system 400. Sprocket 40 is itself driven by a shaft from main drive 20 in a conventional manner.

Sprocket 40 has two parts, inner sprocket 42 and outer sprocket 44. As seen in FIG. 3, as sprocket 44 rotates in the direction of arrow D, pocket roller chain 50 rides on the teeth 44a of sprocket 44. Roller chain 50 is positioned on a stationary support rail 54 secured to the frame 10 of the machine 1. The roller chain 50, and an identical chain 50' on the opposite side of the machine, as seen in FIG. 3, run in a closed or endless path around the machine, returning underneath the machine on the support rails 54 and 54', respectively, in the direction of arrow A' of FIGS. 1 and 3 to the area near the jacket hopper 200. It is to be understood that there are an additional inner sprocket 42' and outer sprocket 44' on the machine at the opposite end to sprockets 42 and 44 of FIG. 3.

Each fixed wall 340 of a pocket 300 is attached to an individual link of the roller chains 50 and 50' by pins 302 and 304, respectively, as seen in FIG. 7. Since the movable wall 320 is hinged to the fixed wall 340, the entire pocket 300 moves with the roller chains 50 and 50' in a closed oval path with the pockets 300 returning to the jacket hopper 200 from underneath the machine 1 in the direction of arrow A' of FIGS. 1 and 3. The roller chains 50 and 50' travel around the closed path on support rails 54 and 54', respectively. The pockets 300 are both *driven* and *supported* by the roller chain 50. Having the same media (roller chains 50 and 50') drive and support the pockets 300 results in using fewer parts and is easier to construct than a system requiring separate means to support and drive the pockets.

It is to be understood that those links of roller chains 50 and 50' which are connected to a specific fixed wall of a pocket will either both be positioned on sprockets 44 and 44' or the guide rails 54 and 54', depending on the linear position of the pocket. In the present embodiment, no fixed wall would actually even be in the position shown in FIG. 7 where roller chain 50 is on the support rail 54 and roller chain 50' is on sprocket 44'. Rather, FIG. 7 shows generally how the roller chains 50 and 50' can be positioned on the sprockets 44 and 44' or guide rails 54 and 54', depending on where the pocket is on the closed path.

Inner sprocket 42, having the same axis of rotation as outer sprocket 44, drives a chain 70 on teeth 42*a*. Chain 70 in turn drives vacuum drive sprocket 420 in the direction of arrow E in FIG. 3. Vacuum system roller chains 440 and 440' ride on sprockets 420 and 420' and a stationary vacuum support rail 442 at the same linear speed roller chain 50 rides on sprockets 44 and 44' and support rails 54 and 54'. Thus, the vacuum system 400 and the pockets 300 are driven synchronously, permitting the application of vacuum by the vacuum system 400 to the pockets 300 in a synchronous fashion, as described below. It is to be understood that FIG. 1, in order to show other parts of the machine, particularly cams 380 and 310 and cam follower 360, does not show any part of the drive system except for main motor drive 20.

VACUUM SYSTEM STRUCTURE AND OPERATION

Figure 10A:
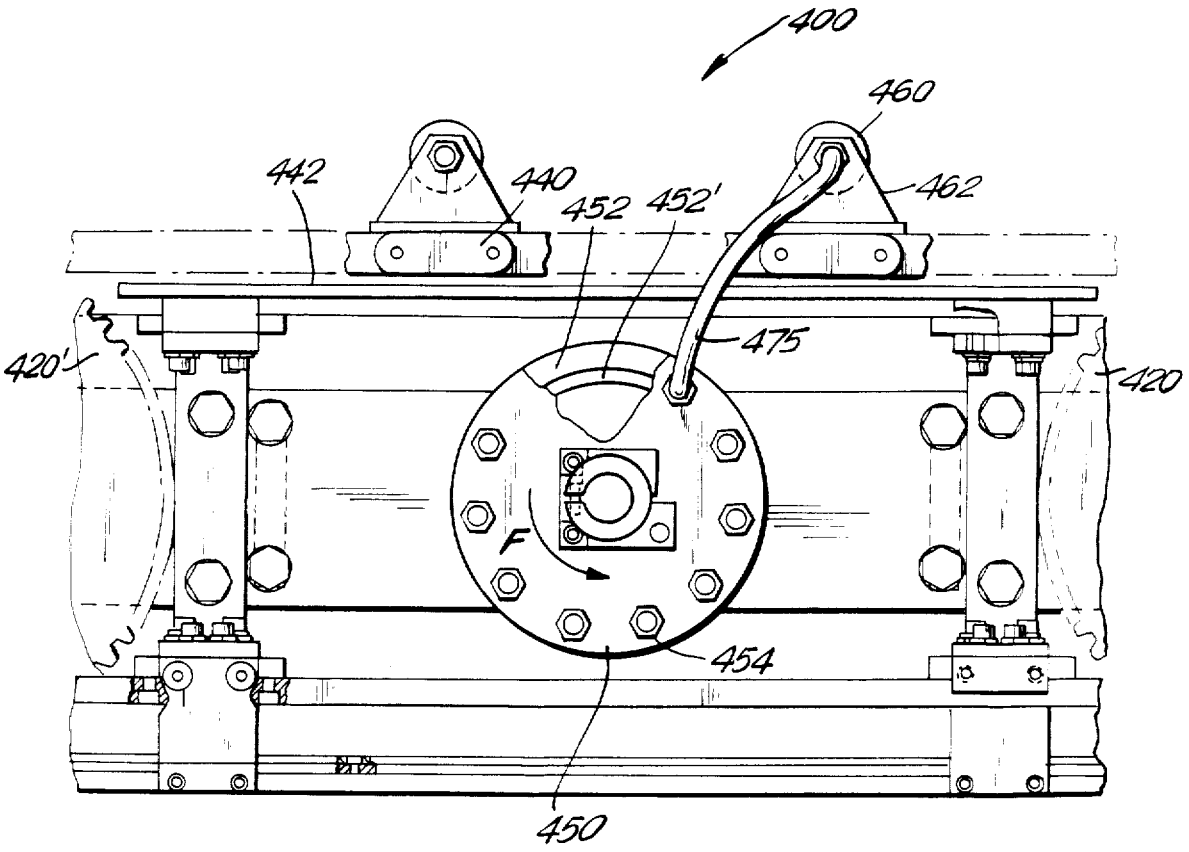
FIG. 10A is a partial elevational view, partly in section, of the vacuum system of FIG. 3.
Figure 10B:
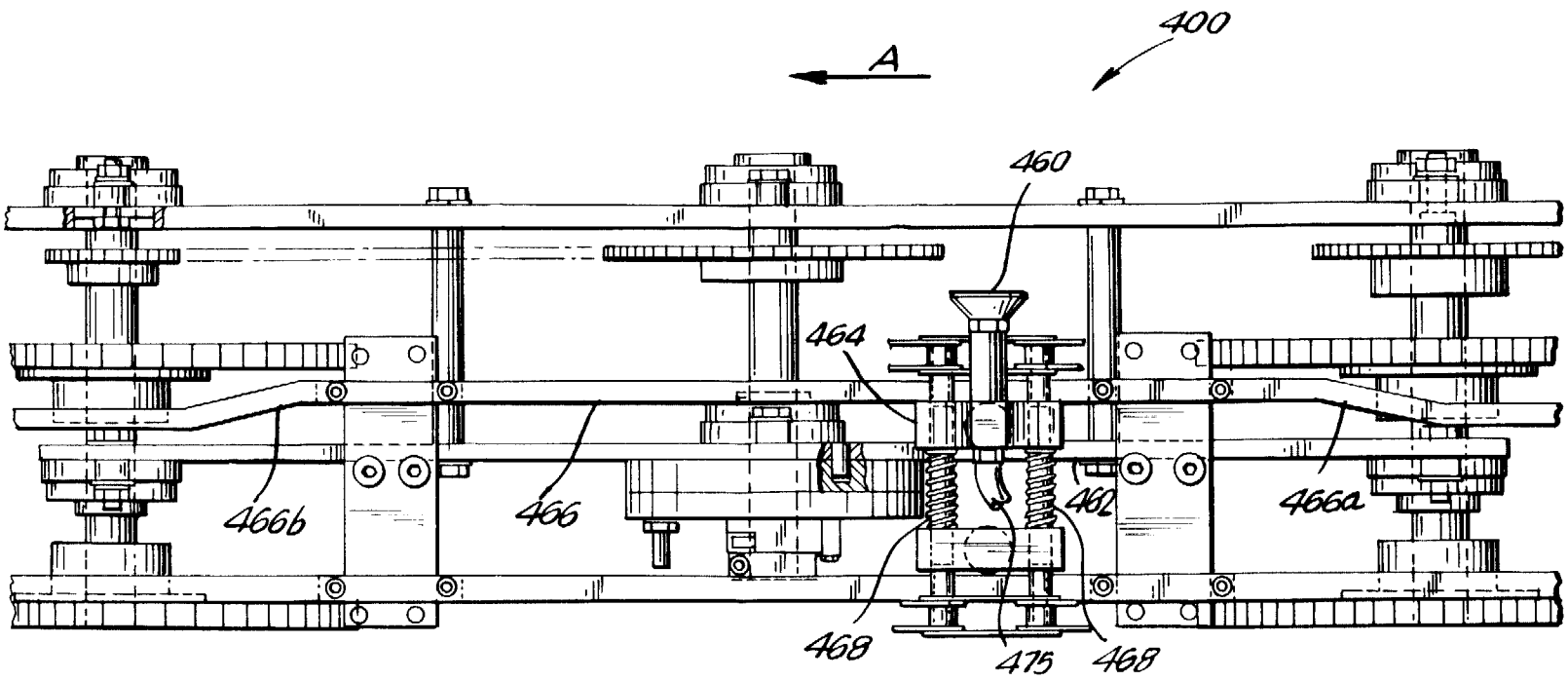
FIG. 10B is a partial plan view of the vacuum system of FIG. 3.

Reference should be made to FIGS. 3, 10A and 10B for details of the vacuum system. As vacuum roller chains 440 and 440' travel on vacuum support rail 442 around sprockets 420 and 420', vacuum flange 460, which is made of a flexible material such as rubber, is physically cammed into contact with the pocket suction stem 345 of the pocket 300. Vacuum flange 460 is carried by a vacuum flange shuttle 462 which is connected by pins to the roller chains 440 and 440'.

Flange 460 is also attcahed to a vacuum cam follower 464 on the shuttle 462. The cam follower 464 rides on a surface of cam 466, as seen in FIG. 10B. As the shuttle 462 moves in the direction of the arrow A of FIG. 10B to point 466*a* in that figure, the cam follower 464 will move with the changing shape of the cam 466 under spring pressure from springs 468 on shuttle 462. This will cause the flange 460 to move toward and mate with the suction stem 345, as seen in FIG. 3.

Between points 466*a* and 466*b* on cam 466, the flange 460 will be physically mated to stem 345.

The distance between adjacent vacuum flanges 460 in the vacuum system 400 is exactly the same as the distance between adjacent pocket suction stems 345 on the pockets 300. Therefore, as vacuum roller chains 440 and 440' and pocket roller chains 50 and 50' move synchronously, a flange 460 will move in mirror fashion with a stem 345 between points 466*a* and 466*b* on cam 466.

Revolving multi-port valve plate 450, rotatably mounted on stationary valve 452, rotates in the direction of arrow F in FIGS. 3 and 10A, at the same speed that roller chains 440 and 440' are moving and allows a vacuum from a vacuum source (not shown) to be applied to vacuum flange 460 only for a predetermined path length as valve plate port 454 rotates to a position over slot 452' of stationary valve 452. Part of slot 452' may be seen in sectional views of the valve plate 450 in FIGS. 3 and 10A. As the vacuum flange 460 comes into the proper position where valve plate 450 permits the vacuum from slot 452' of valve 452 to be applied to the flange 460 through hoses 475, the flange 460 physically mates with the pocket suction stem 345 and a vacuum is applied to the pocket ports 321, 323, 341 and 343 through hoses 380. It is to be understood that in the present embodiment there are 11 flanges 460, each with an accompanying shuttle 462. Each flange 460 is connected by a hose 475 to a valve port 454 on the valve plate 450. It is to be understood that there is a separate hose 475 for each port 454.

The vacuum flange 460 is physically cammed away from the stem 345 at point 466*b* of FIG. 10B simultaneously with the port 454 moving past the opening of slot 452' of valve 452.

Thus, instead of a separate vacuum line for every pocket, the present invention provides a vacuum system 400 for selective application of vacuum to the pocket ports by a rotating set of vacuum lines wherein the vacuum flange 460 willmate with the pocket suction stems 345 and then disengage when vacuum is no longer required. Simultaneously with the physical disengagement by camming action between the flange 460 and the stem 345, the port 454 on valve plate 450 will move past the open slot 452' on valve 452, thus terminating the application of the vacuum.

Numerous advantages may be seen for the machine of the present invention.

Because the sprocket 40 drives both the pocket 300 and the vacuum system 400, the timing is synchronized and vacuum is applied and withdrawn from the pockets 300 at the appropriate instant.

Also, because the machine 1 is in a straight-line, modular configuration, as opposed to the rotary configuratin of some prior art systems, any number of insert hoppers 600 may be added to the system without affecting performance. Also additional pockets with the necessary added frame structure can be added to provide for expanded operatin of the machine.

Another advantage of the present invention is that the pockets 300 are hinged but *closed* at the bottom and the newspaper 100' is removed from the pocket at the *top* by the gripper mechanism 720. In some other systems, the newspaper is released from the bottom of the pocket. Bottom opening pockets limit the ability to use space below the pockets as that space is used in the present invention, where the lower space of the machine 1 is used for returning the pockets 300 along a closed path to the area of the jacket hopper 200, as can be seen in FIGS. 1 and 3. Also, the positive top gripping of the newspaper by the gripper mechanism 720 is a superior design to bottom-opening pockets because the positive gripping acation of the gripper-conveyor of the present invention provides a sure method of removing the completed newspapers from the pockets and does not rely upon the force of gravity which can be adversely affected by friction between the paper and the pocket wall. In bottom-opening pocket systems, newspapers may get stuck in the pocket unless the newspaper is actually taken out of the pocket by some applied force.

Further, in bottom-opening systems the jacket is sometimes stripped from the insert sections as the jacket with inserts drops out of the bottom of the pocket onto a high-speed belt. This occurs because when the jacket first touches the high-speed belt, the belt tends to accelerate the jacket quickly in the direction of movement of the belt without accelerating the insert sections at the same time. This results in the jacket sometimes being stripped away from the insert sections. This problem is not present in the machine of the present invention because the gripper mechanism 720 picks up the jacket with inserts from the top of the pocket, and the inserts remain within the outer portion of the jacket.

Another advantage of the present invention is that insert sections 600 can be placed in the insert hopper 500 from either side of the machine. This allows two or more operators to stack insert sections in the hoppers 500 without obstructing another operator. Also, loading of the insert hoppers 500 from either side provides for greater flexibility in loading of the insert hoppers 500. Thus, for example, the second, fourth, sixth, etc. insert hoppers can be fed by an operator from one side of the machine with the first, third, fifth, etc. insert hoppers fed from the opposite side of the machine by a second operator.

Also, adjacent insert hoppers 500 may be turned 180° so that a single operator may load adjacent insert hoppers 500 without having to move more than a short distance. This feature is particularly useful where large skids adjacent the machine are used to hold the supply of inserts, and the operator cannot easily move around the skid to load an adjacent insert hopper which is oriented in the same direction as the preceding insert hopper.

It will be understood that the straight-line insert machine of the present invention is not limited to the embodiment described above, but rather is defined by the following claims.

We claim:

1. A straight-line insert machine for inserting at least one insert section into the outer-folded portion of an item known as a jacket comprising:

a series of pockets each for holding a single jacket wherein each pocket has a fixed wall and a movable wall and the fixed wall and the movable wall are hingedly connected at the bottom and open at the top;

means for moving the pockets in a closed path;

a jacket hopper for inserting a jacket into each pocket;

first means for closing each pocket after the jacket has been inserted by moving the movable wall toward the fixed wall;

a vacuum system for applying vacuum to the fixed wall and the movable wall while the pocket is closed;

means for opening the pocket while vacuum is applied such that a first jacket portion is held by suction against the fixed wall and a second jacket portion is held by suction against the movable wall;

means for removing the vacuum from the fixed wall and the movable wall;

at least one insert hopper for inserting an insert section into each pocket between the first jacket portion and the second jacket portion;

second means for closing the pocket by moving the movable wall toward the fixed wall;

a series of gripper mechanisms each for picking up and holding the jacket and insert section from the top of each of the pockets while the pocket is closed; and conveyor means for moving the gripper mechanisms in a closed path.

2. The machine of claim 1 wherein the first means for closing comprises at least one cam follower attached to a cam follower arm on the hinge of the pocket riding upon a first surface of at least one stationary cam secured to a frame of the machine wherein as the cam follower rides upon the first surface the movable wall pivots toward the fixed wall on the hinge and the second means for closing comprises the cam follower riding upon a second surface of the stationary cam wherein as the cam follower rides upon the second surface the movable wall pivots away from the fixed wall on the hinge.

3. The machine of claim 1 wherein at least one vacuum flange on the vacuum system moves at the same linear speed as the pocket and comes into physical mating relation over a predetermined path length with at least one pocket stem which is attached to the motor drive.

4. The machine of claim 3 wherein the means for moving the pocket and the means for moving the vacuum flange are drive by the same motor drive.

5. The machine of claim 1 wherein the machine is modular and any number of insert hoppers and pockets can be added to the machine, and the jacket hopper and insert hopper can be loaded from either side of the machine.

6. The machine of claim 1 also including means attached to the fixed wall of the pocket for holding the first jacket portion against the fixed wall.

7. The machine of claim 1 wherein the fixed wall is at a 15° positive angle relative to 0° vertical.

8. The machine of claim 3 also comprising a stationary valve with an open slot of the predetermined length connected to a vacuum source, a valve plate rotatably mounted on the stationary valve, at least one valve plate port on the valve plate and a hose connecting the port to the vacuum flange, wherein the valve plate rotates at the same speed as the linear speed of the vacuum flange and vacuum is applied to the vacuum flange through the hose as the valve port passes over the open slot.

9. The machine of claim 3 wherein camming action is used to physically mate the vacuum flange with the pocket stem.

10. A straight-line modular insert machine for inserting at least one insert section into a newspaper jacket comprising:

a series of pockets each for holding a single jacket wherein each pocket has a fixed wall approximately at a 15° positive angle relative to 0° vertical and a movable wall, wherein the movable wall and the fixed wall are hingedly connected at the bottom and open at the top;

at least one moving roller chain connected to the pockets for moving the pockets in a closed path;

a jacket hopper for inserting a jacket into each pocket;

first means for closing each pocket after the jacket has been inserted by moving the movable wall toward the fixed wall;

a vacuum system for applying vacuum to the fixed wall and the movable wall while the pocket is closed;

means for opening the pocket by pivoting the movable wall to approximately a 25° negative angle relative to 0° vertical while vacuum is applied such that a front jacket portion is held by suction against the fixed wall and a rear jacket portion is held by suction against the movable wall;

means for removing the vacuum from the fixed wall and the movable wall;

at least one insert hopper for inserting an insert section into each pocket between the front jacket portion and the rear jacket portion;

second means for closing the pocket by moving the movable wall toward the fixed wall; and a series of gripper mechanisms attached to a moving conveyor for picking up and holding the jackets and insert sections from the top of each pocket while the pocket is closed.

11. The machine of claim 10 wherein the first means for closing comprises at least one cam follower attached to a cam follower arm on the hinge of the pocket riding upon a first surface of at least one stationary cam secured to a frame of the machine wherein as the cam follower rides upon the first surface the movable wall pivots toward the fixed wall on the hinge and the second means for closing comprises the cam follower riding upon a second surface of the stationary cam wherein as the cam followre rides upon the second surface the movable wall pivots away from the fixed wall on the hinge.

12. The machine of claim 10 wherein at least one vacuum flange on the vacuum system moves at the same linear speed as the pocket and comes into physical mating relation over a predetermined path length with at least one pocket stem which is attached to the pocket.

13. The machine of claim 12 also comprising a stationary valve with an open slot of the predetermined path length connected to a vacuum source, a valve plate rotatably mounted on the stationary valve, at least one valve plate port on the valve plate and a hose connecting the port to the vacuum flange, wherein the valve plate rotates at the same speed as the linear speed of the vacuum flange and vacuum is applied to the vacuum flange through the hose as the valve plate port passes over the open slot.

14. The machine of claim 12 wherein camming action is used to physically mate the vacuum flange with the pocket stem.

* * * * *

UNITED STATES PATENT AND TRADEMARK OFFICE

CERTIFICATE OF CORRECTION

PATENT NO. : 4,723,770

DATED : February 9, 1988

INVENTOR(S) : RANDY R. SEIDEL et al.

It is certified that error appears in the above-identified patent and that said Letters Patent are hereby corrected as shown below:

Col. 2, line 46, change "of" to--to--.

Col. 2, line 49, change "section" to--sections--.

Col. 4, line 56, after "moving" change "of" to--or--.

Col. 6, line 48, change "followr" to--follower--.

Col. 7, line 6, change "followre" to--follower--.

Col. 7, line 57, change "houses" to--hoses--.

Col. 8, line 32, change "pont" to--point--.

Col. 9, line 66, change "attcahed" to--attached--.

Col. 10, line 34, before "port" insert--plate--.

Col. 10, line 45, change "willmate" to--will mate--.

UNITED STATES PATENT AND TRADEMARK OFFICE

CERTIFICATE OF CORRECTION

PATENT NO. : 4,723,770

DATED : February 9, 1988

INVENTOR(S) : RANDY R. SEIDEL et al.

It is certified that error appears in the above-identified patent and that said Letters Patent are hereby corrected as shown below:

Col. 12, lines 41-42 (claim 3), change "motor drive" to--pocket--.

Col. 14, line 12 (claim 11), change "followre" to--follower--.

Signed and Sealed this

Fifth Day of July, 1988

*Attest:*

*Attesting Officer*

DONALD J. QUIGG

*Commissioner of Patents and Trademarks*